US011549520B2

(12) United States Patent
Song et al.

(10) Patent No.: US 11,549,520 B2
(45) Date of Patent: Jan. 10, 2023

(54) DOWNHOLE CENTRIFUGAL PUMP DIFFUSER WITH PROTUBERANT VANES AND RELATED PUMPS AND METHODS

(71) Applicant: Apergy ESP Systems, LLC, Broken Arrow, OK (US)

(72) Inventors: Baojun Song, Tulsa, OK (US); David S. Baillargeon, Owasso, OK (US)

(73) Assignee: APERGY ESP SYSTEMS, LLC, Broken Arrow, OK (US)

( * ) Notice: Subject to any disclaimer, the term of this patent is extended or adjusted under 35 U.S.C. 154(b) by 0 days.

(21) Appl. No.: 17/507,763

(22) Filed: Oct. 21, 2021

(65) Prior Publication Data

US 2022/0065266 A1 Mar. 3, 2022

Related U.S. Application Data

(63) Continuation of application No. 16/361,549, filed on Mar. 22, 2019, now Pat. No. 11,181,123.

(51) Int. Cl.
*E21B 43/12* (2006.01)
*F04D 29/44* (2006.01)
(Continued)

(52) U.S. Cl.
CPC ..... *F04D 29/448* (2013.01); *E21B 43/128* (2013.01); *F04D 1/06* (2013.01); *F04D 7/04* (2013.01); *F04D 13/086* (2013.01); *F04D 1/063* (2013.01); *F04D 13/10* (2013.01); *F04D 29/0413* (2013.01); *F04D 29/445* (2013.01)

(58) Field of Classification Search
CPC ..... F04D 29/44; F04D 29/441; F04D 29/444; F04D 29/445; F04D 29/448; F04D 29/54; F04D 29/541; F04D 29/542; F04D 29/544; F04D 29/548; F01D 1/06; F01D 7/04;
(Continued)

(56) References Cited

U.S. PATENT DOCUMENTS 1,822,945 A * 9/1931 Weis ..... F04D 29/20 415/199.2
2,066,505 A * 1/1937 Wolfe ..... F04D 29/167 277/423
(Continued)

FOREIGN PATENT DOCUMENTS

DE 1092770 B 11/1960
DE 2952427 A1 7/1981
(Continued)

OTHER PUBLICATIONS

International Search Report & Written Opinion dated Jul. 8, 2020 in connection with International Application No. PCT/US2020/023952, 10 pages.
(Continued)

*Primary Examiner* — Richard A Edgar
*Assistant Examiner* — Behnoush Haghighian
(74) *Attorney, Agent, or Firm* — PCFB LLC

(57) ABSTRACT

Stationary diffusers, downhole centrifugal pumps, and methods of pressurizing a fluid may include vanes configured to direct fluid flow through fluid passageways, where at least some of the vanes include a bulge or protrusion extending axially beyond the fluid passageways into an open rotational volume of the diffuser in a direction toward an impeller.

20 Claims, 9 Drawing Sheets

(51) Int. Cl.

| | |
|---|---|
| ***F04D 13/08*** | (2006.01) |
| ***F04D 7/04*** | (2006.01) |
| ***F04D 1/06*** | (2006.01) |
| *F04D 13/10* | (2006.01) |
| *F04D 29/041* | (2006.01) |

(58) Field of Classification Search
CPC ..... F01D 13/086; F01D 13/08; F01D 13/10; E21B 43/128
See application file for complete search history.

(56) References Cited

U.S. PATENT DOCUMENTS 2,273,420 A * 2/1942 Schott ..... F04D 1/066 415/199.2
2,378,974 A * 6/1945 Bower ..... F04D 29/20 415/199.2
2,407,348 A * 9/1946 Schott ..... F04D 29/20 403/354
2,854,926 A * 10/1958 Haight ..... F04D 1/066 415/199.2
3,369,492 A * 2/1968 Merril ..... F04D 29/043 415/901
3,438,329 A * 4/1969 Fuller ..... F04D 29/448 415/199.3
3,440,968 A * 4/1969 Jensen ..... F04D 29/448 415/199.3
3,776,664 A * 12/1973 Kimmell ..... F04D 29/445 415/901
4,278,399 A 7/1981 Erickson
4,838,758 A * 6/1989 Sheth ..... F04D 29/0413 415/199.2
5,722,812 A * 3/1998 Knox ..... F04D 29/0413 415/199.1
6,012,900 A * 1/2000 Kennedy ..... F16C 33/20 415/173.1
6,068,444 A * 5/2000 Sheth ..... F04D 29/445 415/174.3
6,106,224 A * 8/2000 Sheth ..... F04D 29/0465 415/174.3
6,676,366 B2 * 1/2004 Kao ..... F04D 29/2288 415/58.2
8,066,077 B2 * 11/2011 Lawson ..... E21B 43/128 166/105.5
8,568,081 B2 * 10/2013 Song ..... F04D 13/10 415/113
8,790,072 B2 * 7/2014 Boldt ..... F04D 29/047 416/174
8,801,360 B2 * 8/2014 Sheth ..... E21B 43/128 415/199.2
8,894,350 B2 * 11/2014 Brunner ..... F04D 29/0413 415/107
9,109,602 B2 8/2015 Song
9,206,677 B2 * 12/2015 Song ..... F04D 13/10
9,624,930 B2 * 4/2017 Gahlot ..... F04D 7/045
9,638,207 B2 * 5/2017 Jayaram ..... E21B 43/128
9,677,562 B2 * 6/2017 McManus ..... F04D 17/10
9,719,523 B2 * 8/2017 Jayaram ..... F04D 13/10
9,777,741 B2 * 10/2017 Marsis ..... F04D 29/2288
9,816,519 B2 * 11/2017 Nowitzki ..... F16C 33/08
9,829,001 B2 * 11/2017 Jayaram ..... F04D 29/448
D831,702 S * 10/2018 Wilkins ..... D15/7
10,260,518 B2 * 4/2019 Zheng ..... F04D 29/4206
10,359,045 B2 * 7/2019 Webster ..... F04D 1/063
10,371,154 B2 * 8/2019 Jayaram ..... F04D 9/003
10,533,578 B2 * 1/2020 Johnson ..... F04D 29/628
10,683,868 B2 * 6/2020 Nowitzki ..... F04D 29/04
2011/0194926 A1 8/2011 Stair et al.
2013/0051977 A1 2/2013 Song et al.
2014/0178190 A1 6/2014 Gahlot et al.
2017/0122332 A1 * 5/2017 Zheng ..... F04D 29/086

FOREIGN PATENT DOCUMENTS

| | | | |
|---|---|---|---|
| GB | 1107039 | A | 3/1968 |
| JP | H06249200 | A | 9/1994 |
| JP | 2006002689 | A | 1/2006 |
| JP | 2016031064 | A | 3/2016 |
| JP | 2017180193 | A | 10/2017 |
| SU | 1399513 | A1 | 5/1988 |

OTHER PUBLICATIONS

Dover Artificial Lift, "Grindstone Pumps, Dependable Production in Harsh Environments", 2015, 2 pages.

* cited by examiner

DOWNHOLE CENTRIFUGAL PUMP DIFFUSER WITH PROTUBERANT VANES AND RELATED PUMPS AND METHODS

CROSS-REFERENCE TO RELATED APPLICATIONS

This application is a continuation of U.S. patent application Ser. No. 16/361,549 titled "DOWNHOLE CENTRIFUGAL PUMP DIFFUSER WITH PROTUBERANT VANES" and filed Mar. 22, 2019, the disclosure of which is hereby incorporated by reference in its entirety.

TECHNICAL FIELD

The present disclosure generally relates to pumps and in particular, to a pump diffuser configured to optimally transfer fluid from one impeller to another impeller during the operation of a downhole centrifugal pump system.

BACKGROUND

Submersible pumps are generally used to provide "artificial lift" or artificial means that increase upward fluid flow from downhole sources such as production wells. In most instances, submersible pumps include a motor portion that drives a shaft coupled to impellers which are in turn rotationally coupled to diffusers. The impellers and diffusers are alternatingly situated around the shaft in a manner that causes fluid to flow from one impeller into a diffuser, and from the diffuser into another impeller as the shaft rotates. This process of fluid transfer from impeller to diffuser, and from diffuser to an adjacently upper impeller, repeats itself until the fluid travels from the downhole source to an upper destination.

Impellers are designed to accelerate fluid flow upwardly. Diffusers are built to direct fluid flow to an adjacently upper impeller. Specifically, diffusers are designed to have vanes that direct the fluid flow and build fluid pressure when transferring fluid to the adjacently upper impeller. The vanes of a diffuser include a lower pressure surface that receives fluid from an adjacently lower impeller and a higher pressure surface that directs the fluid to the adjacently upper impeller. The low pressure surface usually poses the problem of creating swirling in the fluid being pumped, which in turn reduces the ability of the adjacently upper impeller to optimally receive and accelerate the fluid upwardly.

Additionally, fluid pressure often builds up at the boundary of space, sometimes called a "dead zone," between the diffuser and the adjacently upper impeller. This fluid pressure, which can be considered as potential energy, is generally desirable in centrifugal pumps since an increase in this pressure generally improves the overall efficiency of downhole centrifugal pump systems. However, existing structural limitations of diffuser vane edges at the dead zone restrict the amount of this fluid pressure buildup within the dead zone.

It would be desirable to address these issues.

SUMMARY

According to one aspect of the subject matter described in this disclosure, a stationary diffuser that is operable to interact with an adjacently lower impeller rotationally coupled to the stationary diffuser and operable to reduce fluid flow velocity from the adjacently lower impeller and build fluid pressure in a dead zone between the stationary diffuser and an adjacently upper impeller rotationally coupled to the stationary diffuser is presented. As used herein, the dead zone defines an open rotational area between the stationary diffuser and the adjacently upper impeller. In one implementation, the stationary diffuser comprises a first side for receiving fluid from the adjacently lower impeller and a second side for transferring the fluid upwardly to the adjacently upper impeller rotationally coupled to the diffuser at the second side. The stationary diffuser further includes a central axis cavity extending through the stationary diffuser from the first side to the second side, the central axis cavity having an inner circumferential wall configured to allow a rotational shaft to pass through the stationary diffuser. The rotational shaft is operable to impart rotation to the first and second impellers; the central axis cavity further comprises an outer circumferential surface. The stationary diffuser also includes an axis rim at the second side of the stationary diffuser at the top of the inner circumferential wall. The axis rim in one embodiment circumscribes the central axis cavity at the second side. Moreover, the stationary diffuser includes a skirt circumscribing the central axis cavity and defining a fluid passageway which directs the fluid from the first side to the second side between the outer circumferential surface of the central axis cavity and the skirt. The skirt further has a skirt rim around the axis rim such that the skirt rim is raised above the axis rim and is circumferentially displaced around the axis rim. The stationary diffuser also includes a plurality of vanes which directs fluid flow from the first side to the second side of the stationary diffuser. Each vane of the plurality of vanes of the stationary diffuser comprises a first edge at the first side and a second edge at the second side. The first edge at the first side and the second edge at the second side are connected via a curved fluid passageway. Each curved fluid passageway defines portions of the fluid passageway which directs the fluid from the first side to the second side and reduces a velocity of the fluid. The curved fluid passageway is bounded by the outer circumferential surface of the central axis cavity and the skirt. The second edge also includes a bulge between a proximal edge on the outer circumferential surface and a distal edge on the skirt. The bulge extends upwardly toward the adjacently upper impeller and thereby reducing the dead zone relative to if the second edge extended linearly from the proximal edge on the outer circumferential surface to the distal edge on the skirt.

These and other implementations may each optionally include one or more of the following features. In one implementation, an unprotuberated dead zone is defined as a dead zone that would exist if the second edge extended linearly from the proximal edge on the outer circumferential surface to the distal edge on the skirt. With this definition, the bulge extending upwardly toward the second impeller is of a height sufficient to effectively reduce the dead zone relative to the unprotuberated dead zone by at least 1%. In other embodiments, the bulge extending upwardly toward the second impeller is of a height sufficient to effectively reduce the dead zone relative to the unprotuberated dead zone by at least 5%. In some embodiments, the bulge extending upwardly toward the second impeller is of a height sufficient to effectively reduce the dead zone relative to the unprotuberated dead zone by at least 10%.

The stationary diffuser further converts kinetic energy imparted upon the fluid by the first impeller into potential energy useable by the second impeller to facilitate optimal upward flow of the fluid in the downhole centrifugal pump. Additionally, the inner circumferential wall associated with the central axis cavity is further configured to rotationally couple the first impeller to the stationary diffuser at the first side. Further, the bulge occupying a portion of the dead zone creates a fluid pressure buildup in the dead zone to facilitate optimal transfer of fluid from the diffuser to the second impeller. Moreover, the bulge occupying a portion of the dead zone is adaptable to facilitate a variable fluid pressure buildup within the dead zone based on one or more of: a distance between a proximal point of the proximal edge on the outer circumferential surface, and a distal point of the distal edge on the skirt, a height of the bulge, an angle associated with the bulge, and a planar length associated with the bulge. In some implementations, the height of the bulge is a function of the distance between the proximal point and the distal point, the height of the bulge being substantially perpendicular to the distance between the proximal point and the distal point. Additionally, the height of the bulge is a percentage of the distance between the proximal point and the distal point, the percentage comprising one of 10%, 20%, 30%, and 40%. It is further noted that the height of the bulge depends on a targeted fluid pressure in the dead zone that improves an efficiency of the downhole centrifugal pump. In some instances, the height of the bulge depends on a parameter of reduction that factors at least a targeted fluid pressure desired in the dead zone into computing the height of the bulge. Additionally, the angle associated with the bulge is greater than zero degrees. Further, the bulge edges/bulge surfaces may be filleted or chamfered to further reduce eddy currents in the dead zone, which further facilitates laminar flow of fluid from the diffuser to the second impeller.

The disclosed embodiments provide a diffuser configuration that improves the overall efficiency of downhole centrifugal pumps during diffuser-impeller fluid transfers. Specifically, the present disclosure describes a diffuser configuration that reduces fluid velocity and builds head pressure as fluid travels from a stationary diffuser to an adjacently upper impeller. Moreover, the diffuser described herein facilitates laminar fluid flow from the diffuser to an adjacently upper impeller to allow the adjacently upper impeller to more efficiently receive and upwardly accelerate the fluid. Additionally, the present disclosure describes a diffuser configuration specially purposed to reduce space associated with the dead zone and increase fluid pressure (also referred to as head pressure elsewhere herein) at the dead zone between the diffuser and an adjacently upper impeller. This fluid pressure can be leveraged by the adjacently upper impeller in further accelerating the fluid upwards, thereby improving the overall efficiency of the downhole centrifugal pump.

BRIEF DESCRIPTION OF THE DRAWINGS

The disclosure is illustrated by way of example, and not by way of limitation in the figures of the accompanying drawings in which like reference numerals are used to refer to similar elements. It is emphasized that various features may not be drawn to scale and the dimensions of various features may be arbitrarily increased or reduced for clarity of discussion.

DETAILED DESCRIPTION

At a high level, downhole centrifugal pump systems generally include at least a downhole structure housing a pump coupled to a motor. In some implementations, the downhole structure may include a plurality of pumps coupled to a plurality of motors. Depending on the use scenario, the downhole structure can be submerged in one or more fluid sources (e.g., oil or gas reservoir, aquifer, etc.) as needed. The plurality of pumps in the downhole structure can upwardly pump the fluid from the fluid source to receiving containers (e.g., tanks, vessels, etc.) at a higher elevation relative to the fluid source.

Figure 1:
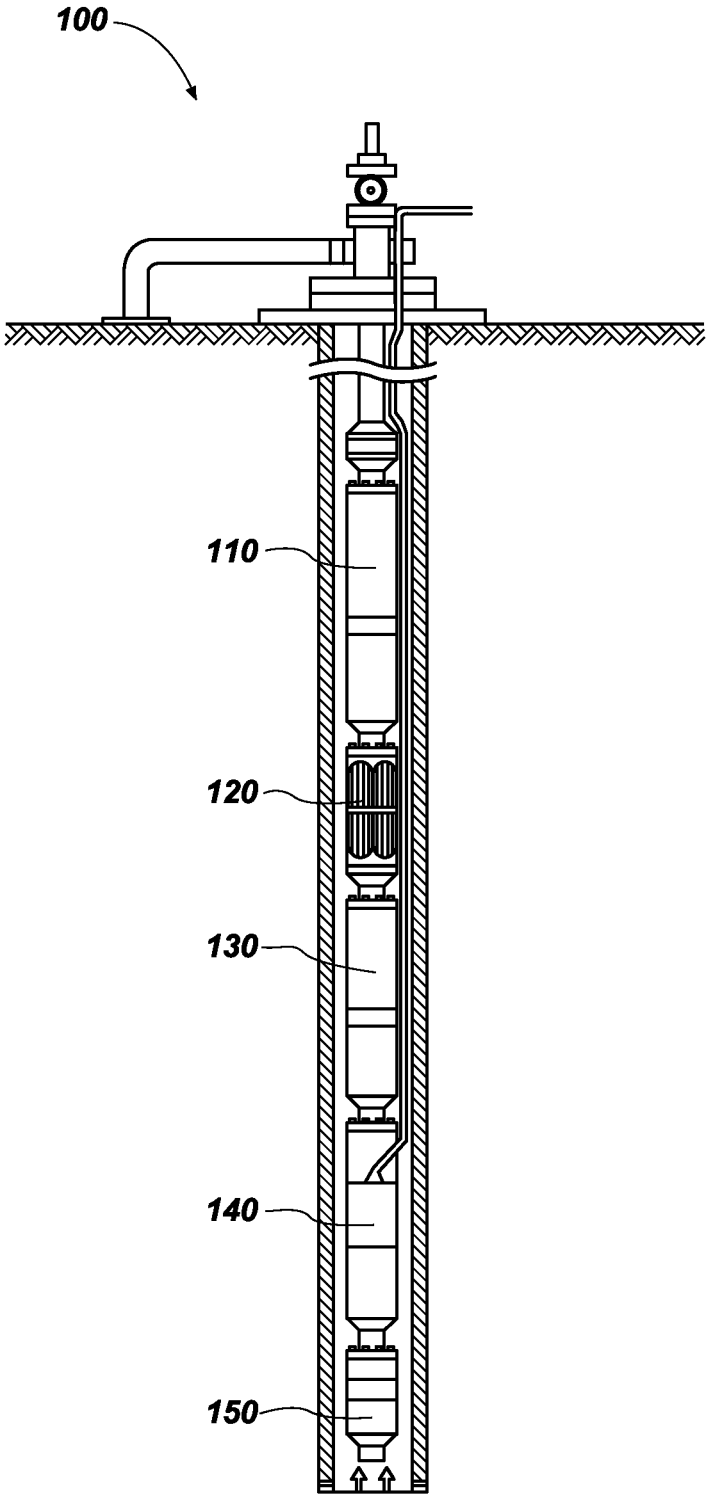
FIG. 1 is an example diagram of a downhole centrifugal pump system.

Turning to the downhole centrifugal pump system 100 of FIG. 1 for example, the downhole structure in one embodiment may include one or more pumps 110, one or more gas handling devices 120, one or more protector devices 130, one or more motors 140, and one or more monitoring devices 150. It should be understood that the reference numerals shown in FIG. 1 can be used in association with single instances of the devices they characterize. For example, some descriptions provided herein could include a pump 110, a gas handling device 120, a protector device 130, a motor 140, and a monitoring device 150.

The pump 110 may include a series of impellers and diffusers that are alternatingly coupled to each other. For example, and as shown in FIG. 2B, the series of impellers and diffusers of the pump 110 may include impeller 214 rotationally coupled to diffusers 212*a* and 212*b*. Diffuser 212*a* may have another impeller (not shown) rotationally coupled at side 250*a* while diffuser 210*b* may also have another impeller (not shown) rotationally coupled at side 250*b*. In some implementations, the pump 110 may be an electric submersible pump (ESP) configured to operate in high-volume wells and/or horizontal or highly deviated wells. For example, the pump 110 may facilitate fluid production from 150 barrels per day (BPD) to 10,000 BPD and may range in size from 4.5 inches to more than 7 inches in diameter. This wide specification range allows the pump 110 to be adaptable to varying drilling conditions. Additionally, the pump 110 may be abrasion-resistant and can handle solids in, for example, high sand production scenarios.

Turning back to FIG. 1, the gas handling device 120 may be configured to mitigate against gas locking by reducing gas interference in the pump 110. In some implementations, the gas handling device 120 may incorporate rotary and vortex gas separators that enhance pump efficiency by preventing free gas from entering the pump 110 in the first place. Operations executed by the gas handling device 120 maximize fluid production by lowering pump drawdown and facilitate well uptime.

The protector device 130 may be configured to ensure electrical and mechanical integrity of the motor 140. In some implementations, the protector device 130 may act as an oil reservoir that facilitates the expansion capacity of the motor 140. The protector device 130 may include a secure seal that keeps the motor 140 running smoothly. Additionally, the protector device 130 may further include one or more chambers adapted to prevent wellbore fluid contamination of the motor 140 by creating a low-pressure boundary between the well fluid and the clean oil used to lubricate the motor 140. Moreover, the protector device 130 may facilitate: torque transfer from the motor shaft to the gas handling device 120 and/or pump intake shaft; reinforcement of the pump shaft; and adaptation of the downhole centrifugal pump system 100 to specific implementation considerations.

The motor 140 may be configured to drive a shaft coupled to the pump 110 of the downhole centrifugal pump system 100. In some embodiments, the motor 140 may be an electric submersible motor configured for variable-speed operations, high temperature tolerance, and deep well pumping. The motor 140 may include one or more circuitry that allows 3-phase operations, 2-pole inductions, etc. In some implementations, the motor 140 may be configured to have sizes such as 375, 420, 456, and 540 and temperature ratings of up to 450 degrees Fahrenheit. The motor 140 may be fabricated using corrosion resistant materials such as stainless steel.

The monitoring device 150 may include software and/or firmware and other hardware that enables monitoring of the downhole centrifugal pump system 100. In some embodiments, the monitoring device 150 may include one or more sensors (e.g., temperature sensors, pressure sensors, etc.) that capture a plurality of information during the operation of the downhole centrifugal pump system 100. This information may be transmitted via a wired and/or wireless channel to user interfaces that facilitate viewing of monitoring data associated with various operations of the downhole centrifugal pump system 100 and/or conditions in which the downhole centrifugal pump system 100 operates.

Figure 2A:
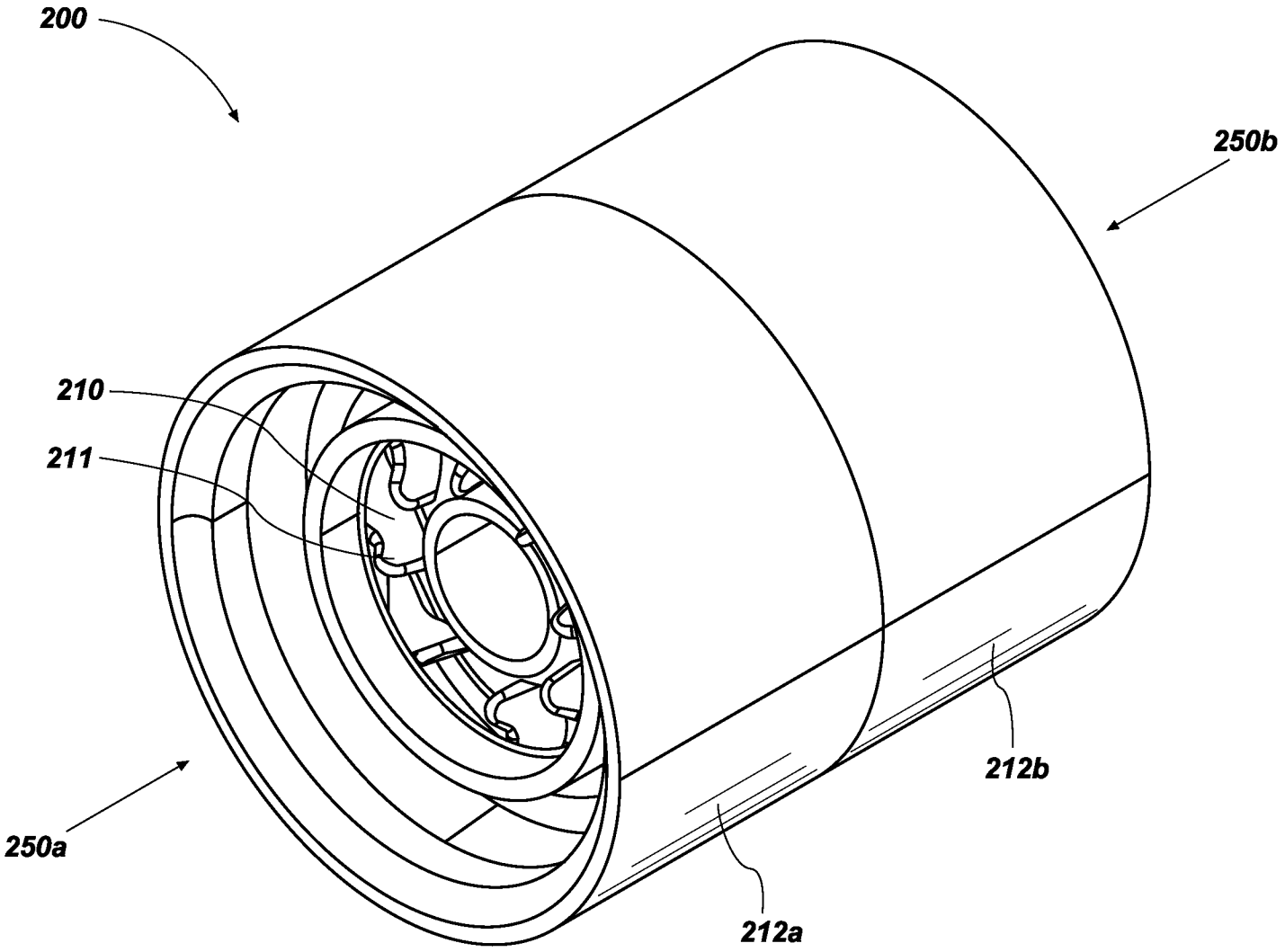
FIG. 2A is perspective view of an embodiment of a presently disclosed diffuser-impeller-diffuser configuration within the pump of the downhole centrifugal pump system.
Figure 2B:
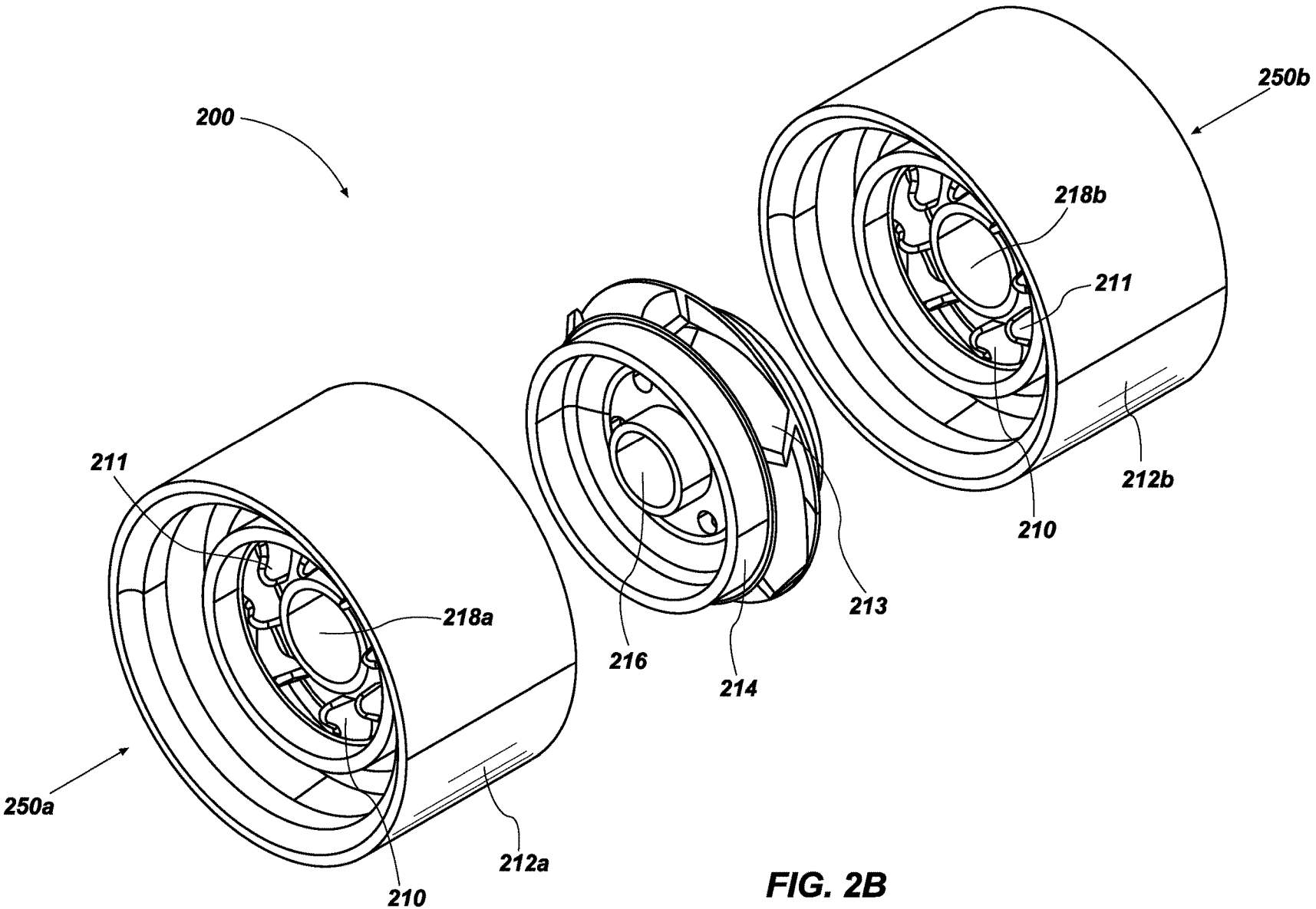
FIG. 2B is an exploded view of the exemplary diffuser-impeller-diffuser configuration of FIG. 2A.

FIG. 2A is an illustration of an example diffuser-impeller-diffuser configuration 200 within the pump 110 of the downhole centrifugal pump system 100. As seen more clearly in the exploded view 210 of FIG. 2B, the diffuser-impeller-diffuser configuration 200 may include impellers and diffusers stacked in an alternating fashion. The stack could include a first diffuser, followed by a first impeller, followed by a second diffuser, followed by a second impeller, and so forth. For instance, the first diffuser could be diffuser 212*b* while the second diffuser could be diffuser 212*a*. Similarly, the first impeller could be impeller 214 while the second impeller (not shown) could be an impeller positioned at side 250*a* of the second diffuser 212*a*. Additionally, each impeller within the pump 110 may have a bore 216 adapted to fit a shaft (also called a drive shaft elsewhere herein) driven by the motor 140. For example, and as shown in FIG. 2B, the bore 216 associated with the impeller 214 serves to fit a shaft driven by the motor 140. The bore 216 may be splined, keyed, or threaded depending on the implementation. The cavities 218*a* and 218*b* are respectively configured to fit a bore structure associated with the bore 216 of the impeller 214. The cavity 218*a* may also fit a bore structure associated with the bore 216 of another impeller 214 rotationally coupled to diffuser 212*a* at side 250*a* while the cavity 218*b* may also fit a bore structure associated with the bore 216 of another impeller rotationally coupled to diffuser 212*b* at side 250*b*.

Figure 2C:
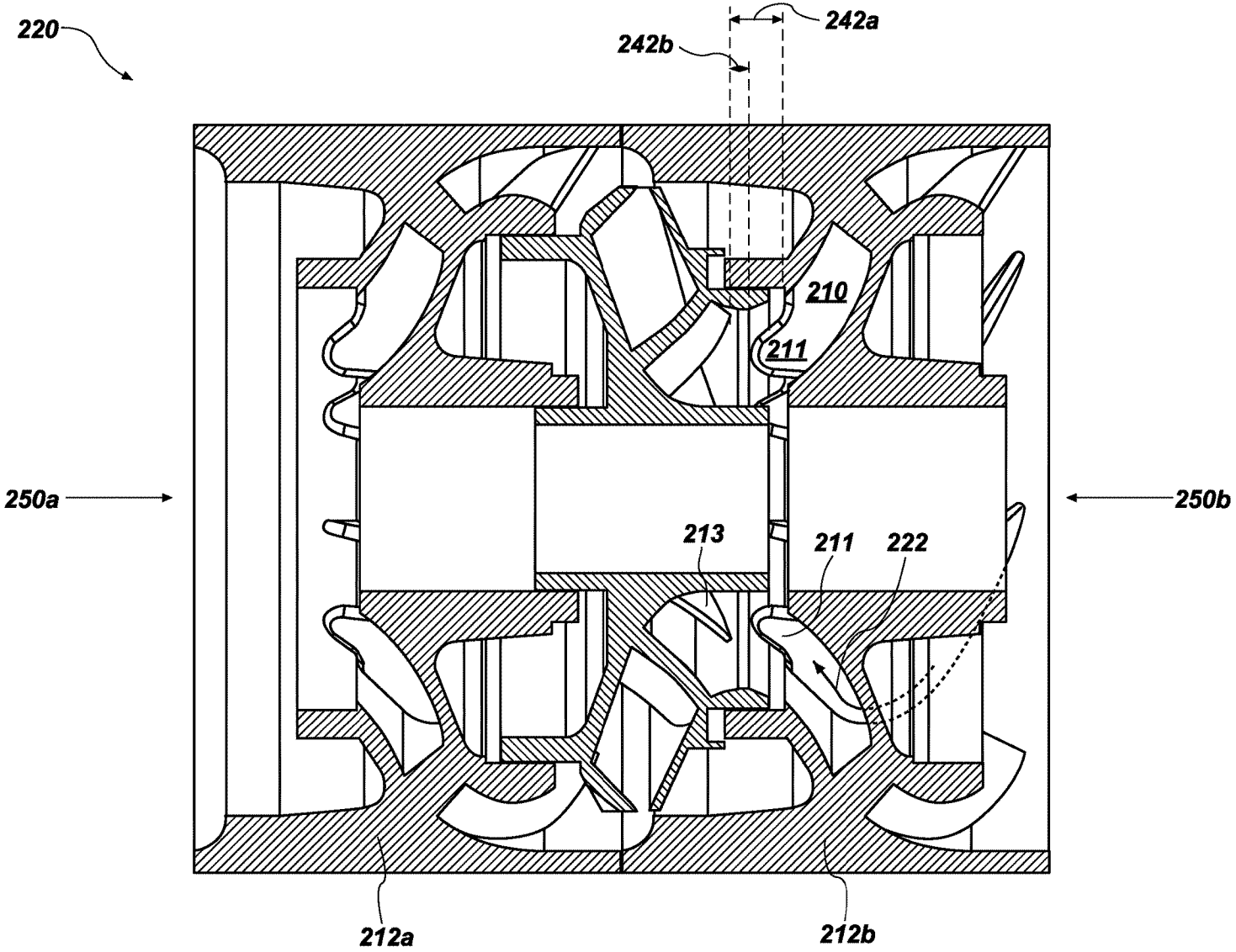
FIG. 2C is a cross-sectional view of the exemplary diffuser-impeller-diffuser configuration of FIG. 2A.

Additionally, the impeller 214 has a plurality of vanes 213 configured to accelerate fluid upwards as the drive shaft causes the impeller 214 to spin. The diffusers 212*a* and 212*b* also include a plurality of stationary vanes 210 that direct fluid to an adjacently upper impeller. An example stationary vane 210 of the diffuser 212*b* is shown in exploded view 210 and in the cross-sectional views 220 of FIGS. 2B and 2C, respectively. It should be understood that the diffuser-impeller-diffuser configuration 200 may include radial and/or mixed flow impellers and diffusers configured to operate in high volume pumping applications.

During the normal operation of the downhole centrifugal pump system 100, each impeller within the diffuser-impeller-diffuser configuration 200 transfers kinetic energy from the shaft driven by the motor 140 into fluid being pumped by accelerating the fluid upwards/outwards from a center of rotation. Specifically, each impeller 214 of the diffuser-impeller-diffuser configuration 200 may be configured to have an open inlet called an eye which receives incoming fluid which is subsequently accelerated by the vanes 213 of the impeller 214 upwards to a matching diffuser 212. The velocity of the impeller 214 imparts kinetic energy upon the fluid which is later converted to pressure or potential energy by the matching diffuser 212. That is to say that the matching diffuser 212 converts kinetic energy imparted upon the fluid by the impeller 214 (i.e., as the impeller 214 rotates) into potential energy or head pressure that is useable by another impeller rotationally coupled to the diffuser 214 at the dead zone (also called dead zone space elsewhere herein) in order to facilitate optimal upward flow of the fluid in the downhole centrifugal pump system 100. It is noted that each impeller within the diffuser-impeller-diffuser configuration 200 may be fabricated using bronze, stainless steel, cast iron, polycarbonate, and/or other materials.

Each diffuser 212 in the diffuser-impeller-diffuser configuration 200 may be configured to have stationary vanes 210 that surround a matching impeller (i.e., an adjacently lower impeller 214). More specifically, the stationary vanes 210 of the diffuser 212 may receive fluid from an adjacently lower impeller 214 at a low pressure side of the diffuser 212 and transfer the received fluid to a high pressure side of the diffuser 212 via the stationary vanes 214. For example, the diffuser 212*a* may have an adjacently lower impeller 214 (see either FIG. 2B or FIG. 2C) at its low pressure side from which fluid is received, and transfers the received fluid via its stationary vanes 210 to an adjacently upper impeller situated at side 250*a* of diffuser 212*a*. In some embodiments, each impeller and a matching diffuser may be referred to as a stage. For example, and as shown in either FIG. 2B or FIG. 2C, a first stage may constitute the impeller (not shown) located at the side 250*b* with matching diffuser 212*b* whiles a second stage may constitute impeller 214 with matching diffuser 212*a*. In other words, at any stage of the diffuser-impeller-diffuser configuration 200, fluid is transferred from an adjacently lower impeller 214 and received by a matching diffuser 212.

During the transmission of fluid from the adjacently lower impeller 214 to the matching diffuser 212, the fluid passes through a curved fluid passageway 222 (see FIG. 2C) associated with the stationary vanes 210 of the matching diffuser 212. While the fluid travels through the curved fluid passageway 222, it encounters a flow area associated with the stationary vanes 210 that cause a reduction in the velocity of the fluid. This reduction in fluid velocity causes an energy conversion in the fluid. That is to say that the kinetic energy in the fluid moving from the adjacently lower impeller 214 to the matching diffuser 212 is converted to potential energy in the form of pressure as the fluid passes through the stationary vanes 210 of the matching diffuser 212 to a boundary (dead zone 242*b*—see FIG. 2C) between the matching diffuser 212 and an adjacently upper impeller 214 after rotationally coupling the adjacently upper impeller 214 to the diffuser 212. This boundary, also called dead zone/dead zone space is defined as an open rotational area between the diffuser 212 and the adjacently upper impeller 214. Prior art dead zone space 242*a* and reduced dead zone space 242*b* are further discussed below and in conjunction with FIGS. 2C, 3, and 4.

In some implementations, the diffuser-impeller-diffuser configuration 200 may be a multi-stage configuration where the fluid pressure is progressively increased as fluid travels from one stage to another. The pressure buildup at any stage, or a combination of stages associated with the diffuser-impeller-diffuser configuration 200, is desirable as this pressure can be leveraged in improving the overall efficiency of the downhole centrifugal pump system 100.

Figure 3:
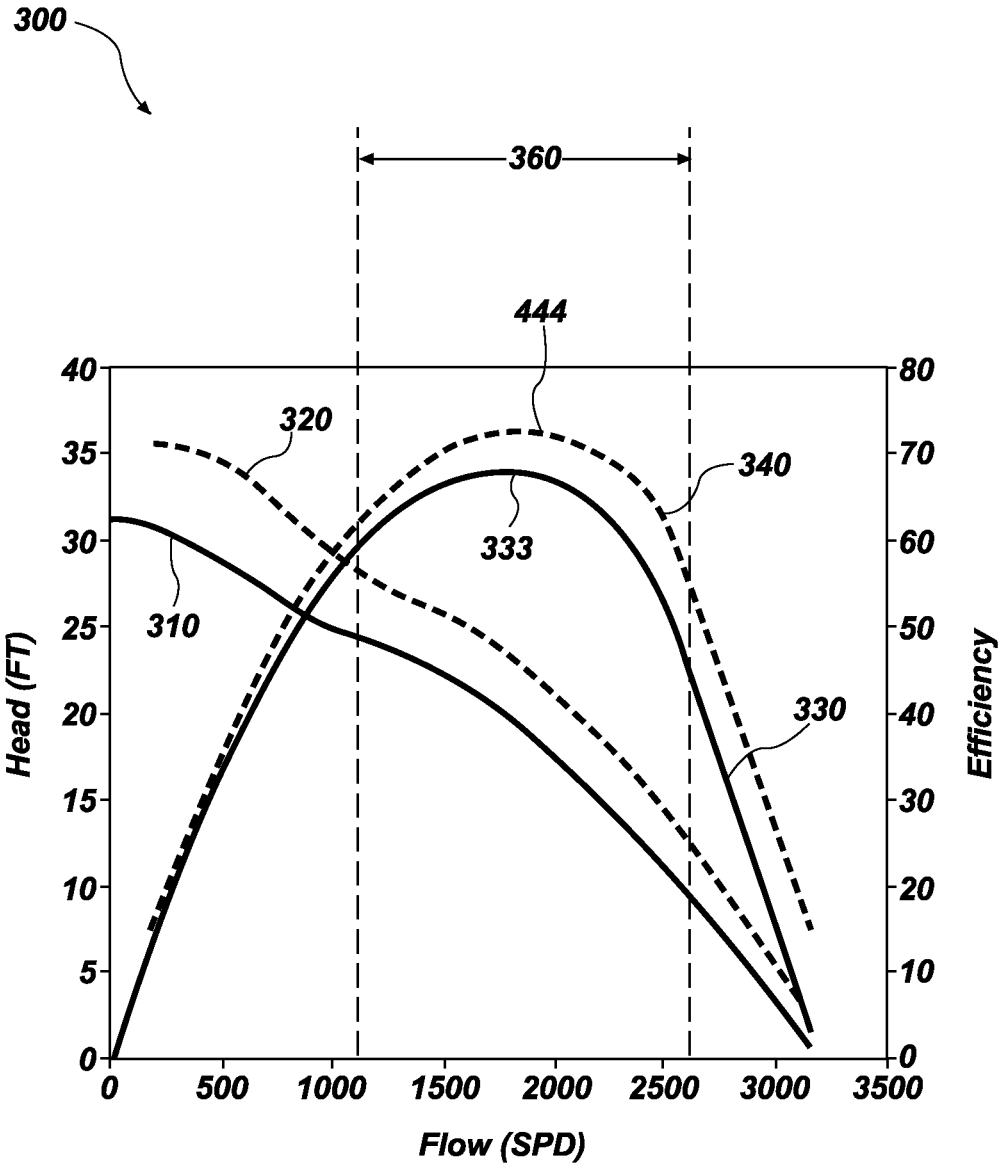
FIG. 3 shows a performance graph for a presently disclosed diffuser configuration relative to a prior art configuration without protuberances.

For example, FIG. 3 shows a performance graph 300 for a presently disclosed diffuser configuration 200 relative to a prior art configuration. As seen in the figure, the horizontal axis represents fluid production rate in barrels per day (BPD) whiles the vertical axis to the left is calibrated to reflect head pressure and is measured in feet (FT). The vertical axis to the right is calibrated to show the overall efficiency of each of the two diffuser configurations. The pressure plot 310 and efficiency plot 330 are associated with a prior art diffuser configuration of the downhole centrifugal pump system 100 whereas the pressure plot 320 and the efficiency plot 340 are associated with an analogous presently disclosed diffuser configuration having disclosed protuberances on the stationary vanes of the diffuser of the downhole centrifugal pump system 100. In particular, the pressure plot 310 depicts a plot of the head pressure against flow rate for the prior art diffuser configuration whereas the pressure plot 320 depicts a plot of the head pressure against flow rate for the presently disclosed diffuser configuration with protuberances 211 on the stationary vanes. Similarly, the efficiency plot 330 shows a plot of efficiency against flow rates ranging from 0 to 3300 BPD for the prior art diffuser configuration while the efficiency plot 340 illustrates a plot of efficiency against the flow rate (also ranging from 0 to 3300 BPD) for the presently disclosed diffuser configuration with protuberances 211 on the stationary vanes. Also shown in the performance graph 300 is a preferred operating range 360 for the downhole centrifugal pump system 100. The preferred operating range 360 is a region on the performance graph 300 extending bi-directionally by a designated amount (in this case the designated amount is approximately 750 BPD) about the best efficiency points 333 and 444 respectively associated with the efficiency plot 330 and the efficiency plot 340. In most instances, the preferred operating range 360 can be determined based on factors such as the type of diffuser configuration, power considerations associated with the downhole centrifugal pump system 100, and whether the downhole centrifugal pump system 100 is being used in low-flow or high-flow applications. As is further discussed with reference to FIGS. 4A-4C, the performance graph 300 indicates that a diffuser configuration with a higher pressure plot would also be more efficient in the preferred operating range 360 than a diffuser configuration with a lower pressure plot given similar operating conditions. More specifically, the test results shown in performance graph 300 indicate that a diffuser configuration having a larger prior art dead zone space 242*a* (see FIG. 2C) due to its lack of protuberances 211 on its stationary vanes would be less efficient compared to the diffuser configuration (see FIG. 4A) having the reduced dead zone space 242*b* created by the protuberances 211 rotating through and thereby reducing the volume of the dead zone 242 between the vanes of the impeller 214 and the diffuser 212.

Figure 4A:
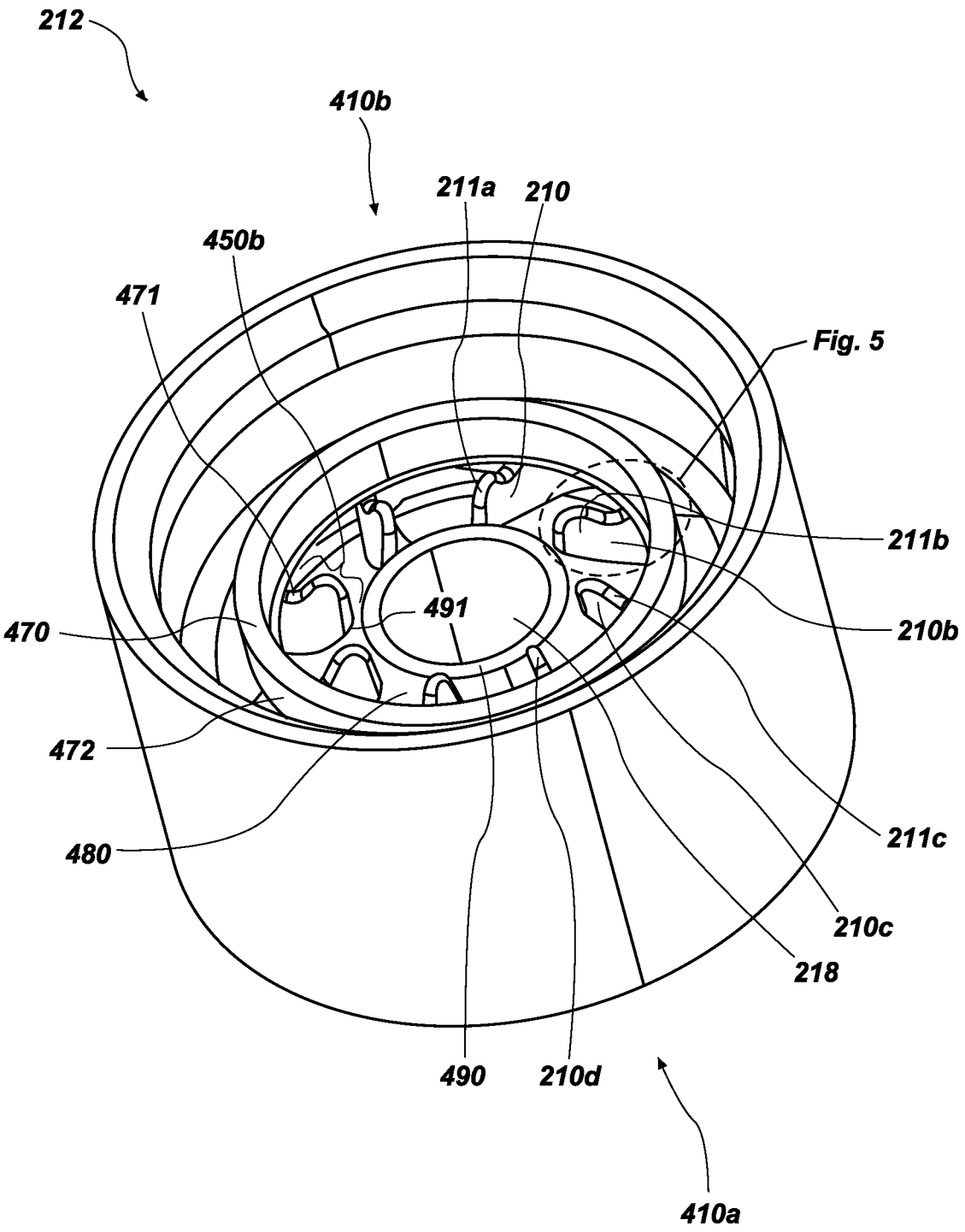
FIG. 4A is a top perspective view of a diffuser configured to increase the pressure build-up at the dead zone during the operation of the downhole centrifugal pump system.

FIG. 4A is a top perspective view of a diffuser 212 (also called a stationary diffuser elsewhere herein) configured to increase the pressure buildup at the dead zone 242 during the operation of the downhole centrifugal pump system 100. As shown in the figure, the diffuser 212 may include a first side 410*a* and a second side 410*b*, respectively corresponding to a low pressure side and a high pressure side. In some embodiments, the low pressure side is rotationally coupled to a matching impeller 214 as discussed with reference to FIGS. 2A-2C. The diffuser 212 can receive fluid from the matching impeller 214 at the lower pressure side 410*a* and transfer (e.g., transfer upward and/or transfer sideward) the fluid to another impeller 214 at the higher pressure side 410*b*. For example, the diffuser 212 is operable to: receive fluid moving with a high velocity from a matching impeller 214 at its lower pressure side 410*a*; reduce the fluid velocity as the fluid travels through its stationary vanes 210; and convert kinetic energy in the fluid after the fluid travels through the stationary vanes 210 and arrives at a dead zone between the diffuser 212 and an adjacently upper impeller 214 rotationally coupled to the diffuser 212 at the higher pressure side 410*b*. In other words the diffuser 212 comprises a first side 410*a* (i.e., low pressure side) and a second side 410*b* (i.e., high pressure side) respectively configured to receive fluid from an adjacently lower impeller 214 at the first side 410*a* and transfer the fluid upwardly to an adjacently upper impeller 214 at the second side 410*b* in order to build head pressure in the dead zone between the adjacently upper impeller 214 and the diffuser 212. This head pressure is useable by the adjacently upper impeller 214 to optimally move the fluid upwards.

Also shown in FIG. 4A is a central axis cavity 218 extending through the diffuser 212 from the first side 410*a* to the second side 410*b*. The central axis cavity 218 has an inner circumferential wall configured to allow a rotational shaft (i.e., drive shaft) to pass through the diffuser 212. As discussed above, the rotational shaft is operable to impart rotation to the adjacently lower and adjacently upper impellers 214. At the top of the inner circumferential wall of the central axis cavity 218 is an axis rim 490 which circumscribes the central axis cavity at the second side 410*b*. The inner circumferential wall is further configured in some embodiments to rotationally couple the adjacently lower impeller 214 at the first side 410. In such cases, the drive shaft is passed through the bore 216 of the adjacently lower impeller 214 before/after coupling the adjacently lower impeller 214 to the diffuser 212 via the inner circumferential wall. It should be noted that the central axis cavity 218 also includes an outer circumferential surface 480, which is discussed below in association with vane edges of the diffuser 212. The diffuser 212 also includes a skirt 472 circumscribing the central axis cavity 218 and defining a fluid passageway which directs fluid from the first side 410*a* to the second side 410*b* between the outer circumferential surface 480 of the central axis cavity 218 and the skirt 472. Additionally, the skirt has a skirt rim 470 around the axis rim 490 such that the skirt rim 470 is raised above the axis rim 490 and is circumferentially displaced around the axis rim 490.

Moreover, the diffuser 212 includes a plurality of stationary vanes 210 that direct a high velocity fluid from the matching impeller 214 at the lower pressure side 410*a* to another impeller 214 at the higher pressure side 410*b*. For example, the plurality of stationary vanes 210 of diffuser 212 include stationary vanes 210*a*, 210*b*, 210*c*, 210*d*, and so forth, that direct the high velocity fluid from a matching impeller 214 at the lower pressure side 410*a* to another impeller 214 at the higher pressure side 410*b*. The plurality of stationary vanes 210 of the diffuser 212 are stationary relative to the impellers 214 of the downhole centrifugal pump system 100.

Figure 4B:
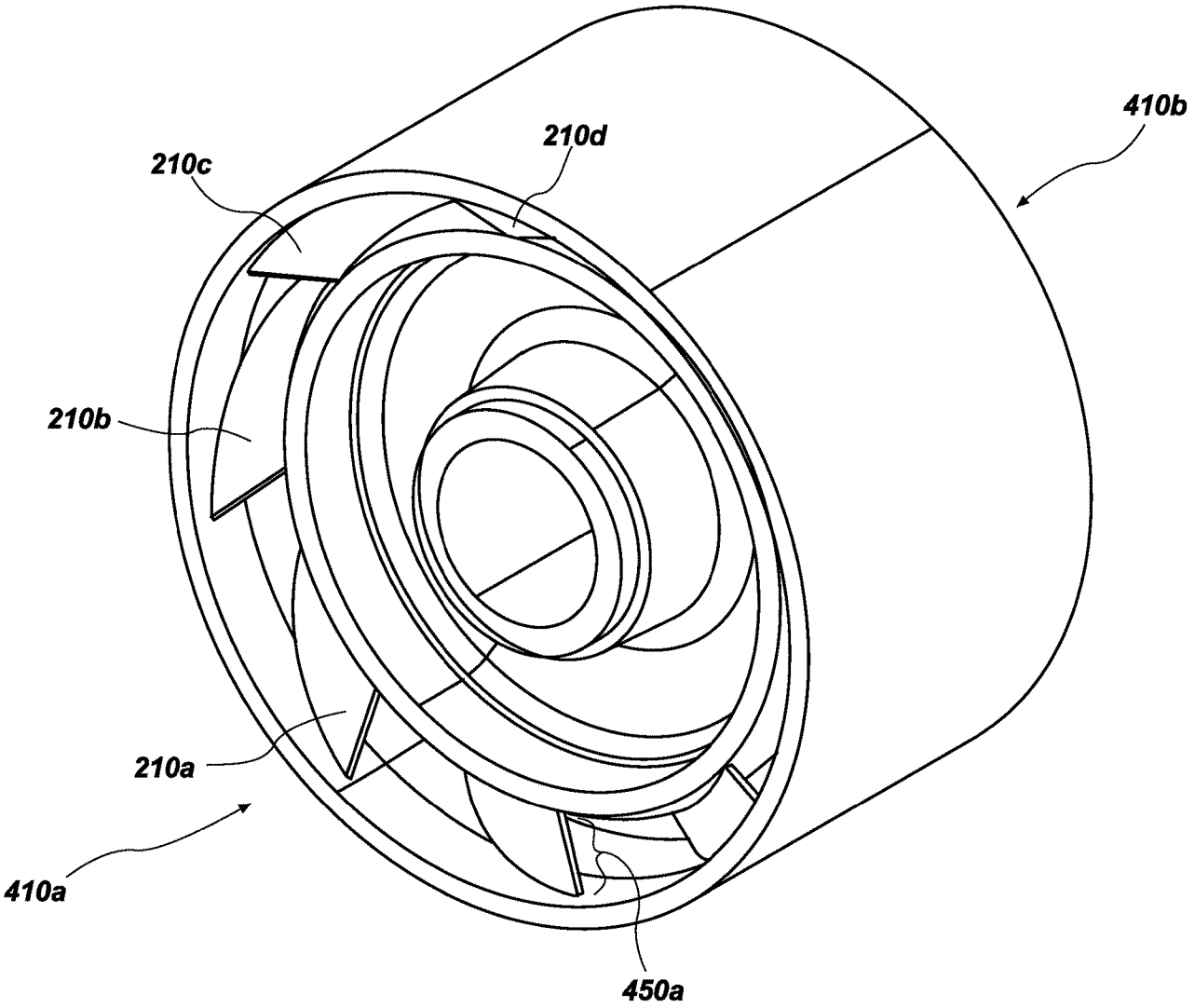
FIG. 4B is a bottom perspective view of the diffuser of FIG. 4A.

Turning to FIG. 4A in association with FIG. 4B, each vane 210 of the diffuser 212 includes a first edge 450*a* (see FIG. 4B) located at the first side 410*a* and a second edge (also called protuberated second edge elsewhere herein) 450*b* (see FIG. 4A) located at the second side 410*b*. The first edge 450*a* is connected to the second edge 450*b* via a curved fluid surface (i.e., curved fluid passageway 222 shown in FIG. 2). Each curved fluid passageway 222 defines portions of the fluid passageway which directs the fluid from the first side to the second side as discussed above with reference to the skirt 472. Moreover, each curved fluid passageway 222 also reduces the velocity of the fluid as the fluid travels into the dead zone space. In some embodiments, the curved fluid passageway is bounded by the outer circumferential surface 480 of the central axis cavity 218 and the skirt 472.

The second edge 450*b* includes a bulge which protrudes into the dead zone space 242*a*. More specifically, the bulge extends/protrudes upwardly toward the adjacently upper impeller 214 thereby reducing the dead zone relative to if the second edge 450*b* extended linearly from the outer circumferential surface to the skirt. The extent to which the bulge of the second edge 450*b* protrudes into the dead zone space 242*a* is a design parameter that can be adapted to meet the needs of varying pumping scenarios. For instance, the bulge of the second edge 450*b* of each vane may protrude into the dead zone to create an accumulation of protrusions occupying a percentage of the dead zone space as determined by a virtual rotation of the fluid in the dead zone as described herein. In some embodiments, the effective percentage of the dead zone space 242*a* occupied by the accumulated protrusions/bulges could be at least one of 10%, 20%, 30%, or 40% of the dead zone space 242*a* depending on the application, and in accordance with design needs and the principles described in the present application. For example, in a configuration associated with performance graph 300 of FIG. 3, the original dead zone space associated with a diffuser configuration without any protrusions on its stationary vanes may be the prior art dead zone space 242*a* shown in association with FIG. 2C.

In other embodiments, the reduction of the dead zone is further clarified based on an unprotuberated dead zone. An unprotuberated dead zone is defined as a dead zone that would exist if the second edge extended linearly from the outer circumferential surface to the skirt as discussed elsewhere herein. However, because the second edge 450*b* has a bulge that extends upwardly toward the adjacently upper impeller 214, the height of the bulge associated with the second edge 450*b* is sufficient to effectively reduce the dead zone relative to the unprotuberated dead zone by a designated amount. Example unprotuberated dead zone is prior art dead zone space 242*a* while the reduced dead zone space 242*b* may be associated with the diffuser 212 of FIG. 4A. In one embodiment, the bulge of the second edge 450*b* extending upwardly toward the adjacently upper impeller 214 is of a height sufficient to effectively reduce the dead zone relative to the unprotuberated dead zone by at least 1%. In another embodiment, the bulge of the second edge 450*b* extending upwardly toward the adjacently upper impeller 214 is of a height sufficient to effectively reduce the dead zone relative to the unprotuberated dead zone by at least 5%. In other implementations, the bulge of the second edge 450*b* extending upwardly toward the adjacently upper impeller 214 is of a height sufficient to effectively reduce the dead zone relative to the unprotuberated dead zone by at least 10%. As discussed herein, the percentage reduction relative to the dead zone space 242*a* is defined by the volume of the prior art dead zone space 242*a* occupied by a "virtual" rotation of the protuberance 211 around the central axis of the diffuser. The rotation is "virtual" because the diffuser is stationary, but its effective volume is computed rotationally because the impeller 214 is rotating the fluid within the dead zone 242 relative to the diffuser 212.

Figure 4C:
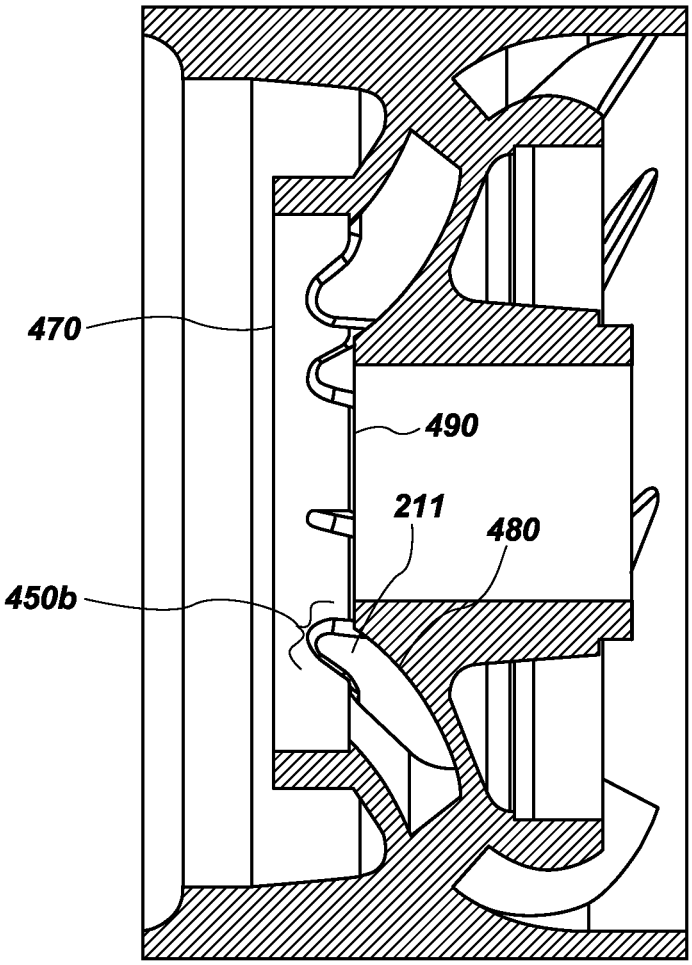
FIG. 4C is a cross-sectional view of the diffuser of FIGS. 4A and 4B.

Structurally, the bulge of the second edge 450*b* may be connected to the outer circumferential surface 480 and the skirt 472. As seen in FIG. 4A, the bulge of the second edge 450*b* attaches to a distal edge 471 below an inner surface structure of the skirt 472 and to a proximal edge 491 on the outer circumferential surface 480 of the central axis cavity 218. In one implementation, the bulge of the second edge 450*b* protrudes above the axis rim 490 and is lower in height relative to the skirt rim 470. The positional relationships between the bulge of the second edge 450*b*, the axis rim 490 and the skirt rim 470 are shown in FIG. 4C, which depicts a cross-sectional view of the diffuser 212 showing the position of the bulge of the second edge 450*b* relative to the axis rim 490 and the skirt rim 470.

The protuberated structure/bulge of the second edge 450*b* is highly desirable over existing diffuser configurations lacking this feature. As shown via the experimental results in the plots of FIG. 3, the protuberated nature of the second edge 450*b* of each of the stationary vanes 210 of the diffuser 212 facilitates a higher pressure buildup/head pressure at the dead zone 242 as compared to the lower pressure buildup at the dead zone 242 using the prior art diffuser configurations that merely have a second edge that is relatively linear in structure and lacks a protuberance. Turning back to FIG. 3, the pressure plot 310 is associated with a downhole centrifugal pump system having diffuser configurations whose second edge lacks any protuberance/bulge like those discussed above with reference to FIG. 4A. As a result, the pressure plot 310 can be associated with a downhole centrifugal pump system with a dead zone space substantially similar to the dead zone space 242*a* of FIG. 2C. Accordingly, and particularly for the preferred operating range 360, the head pressure for the prior art solution ranges from approximately 10 feet to 25 feet. This head pressure range in most instances is typical of diffuser configurations lacking any protrusions into the dead zone space 242*a*. By contrast, the pressure plot 320 associated with the downhole centrifugal pump system 100 having a protuberated second edge 450 of the diffuser configuration shown in FIG. 4A approximately ranges from 12 feet to 28 feet within the preferred operating range 360 of the performance graph 300. This is largely because the dead zone space associated with pressure plot 320 is substantially equivalent to the reduced dead zone space 242*b* of FIG. 2C. Consequently, for low-flow applications to high-flow applications, the test results shown by the performance graph 300 generally indicate that even outside the preferred operating range 360, the diffuser configuration of FIG. 4A has a higher pressure buildup at the dead zone compared to diffuser configurations lacking the protuberated features described above.

Additionally, within the preferred operating range 360 of the performance graph 300, the efficiency plot 340 which is the efficiency plot corresponding to a downhole centrifugal pump system having the protuberated edge (or bulge) shown in FIG. 4A is relatively higher than the efficiency plot 330 corresponding to the downhole centrifugal pump with a diffuser configuration lacking the protuberated edge at the high pressure side. In particular, at flow rates of about 1850 BPD, the efficiency plot 340 has a high efficiency approximately equivalent to 72% whereas the efficiency plot 330 has a high efficiency approximately equivalent to 67% within the preferred operating range 360. The 5% performance improvement of efficiency plot 340 over efficiency plot 330 at 1850 BPD production rate nontrivially illustrates the benefits derived from utilizing diffuser configurations with protuberated second edges as described herein. Thus, the data from the graph 300 generally indicates that given similar conditions except for vane edge protuberance at the high pressure side of a diffuser, diffuser configuration 400 outperforms existing diffuser configurations that lack the protuberated vane edge features discussed above.

Figure 5:
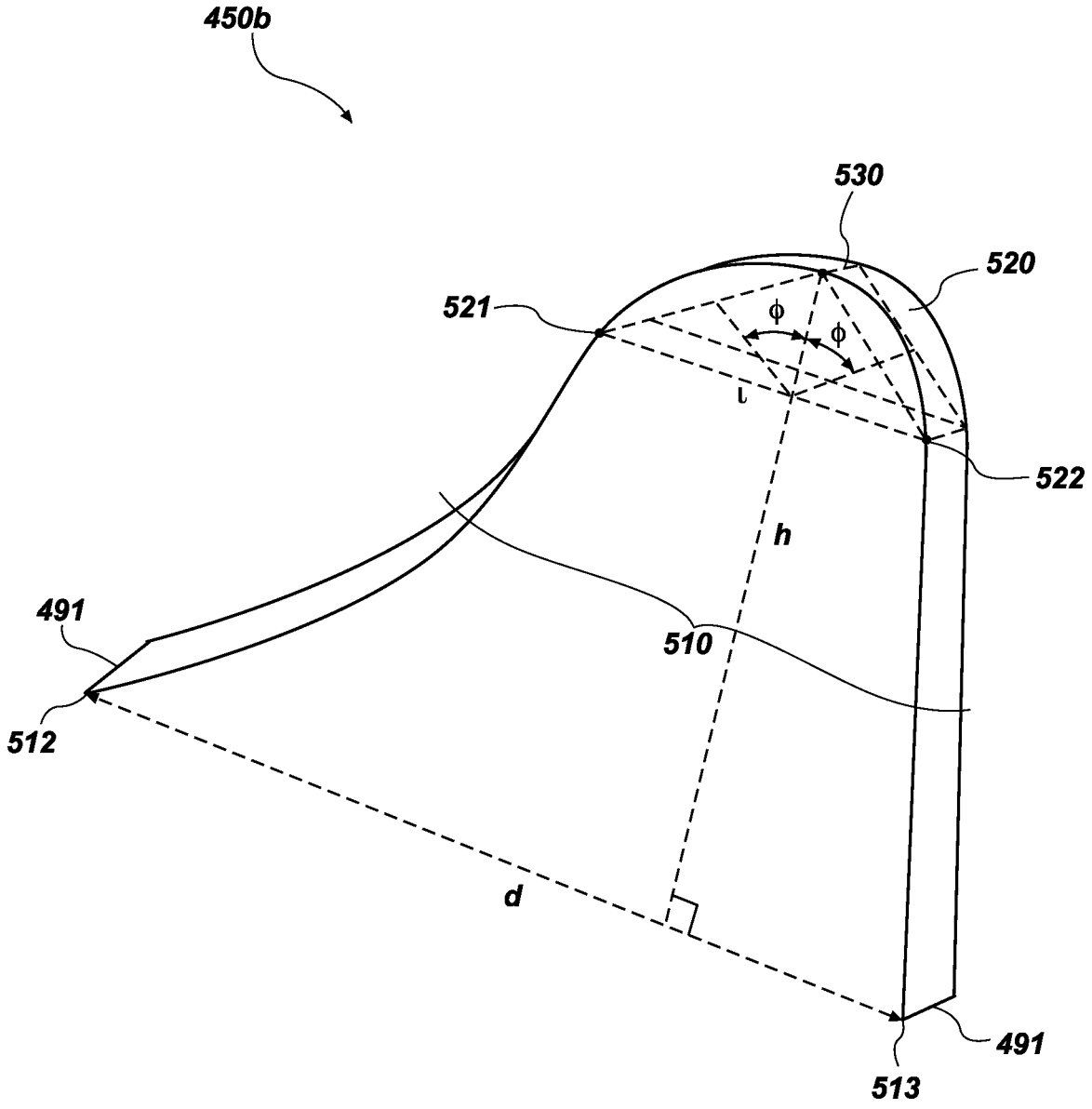
FIG. 5 is a zoomed-in view of a protuberated second edge of an exemplary vane of FIG. 4A.

FIG. 5 is a zoomed-in view of a protuberated second edge 450*b* of an exemplary vane 210 of FIG. 4A. As seen in the figure, the protuberated second edge 450*b* includes a bulge 510 (associated with protuberances 211*a*, 211*b*, 211*c*, 211*d*, etc. of FIGS. 2B, 2C, and 4A) having a height h. Specifically, the height h reflects the extent to which the bulge 510 protrudes into the dead zone. In some implementations, the height h of the bulge 510 may be a function of the distance d between a proximal point 513 of the proximal edge 491 and a distal point 512 of the distal edge 471. For example, the height h of the bulge 510 may be less than the distance d and may be computed based on a percentage by which the dead zone space 242*a* (see FIG. 2C) must be decreased by the bulge 510 of the second edge 450*b*. For instance, the height h may be computed using the formula:

$$h=\alpha\times d,$$

such that $h\leq d$, and $\alpha$ is a parameter of reduction.

In some implementations, $\alpha$ may be a percentage having a value of at least one of 10%, 20%, 30% and 40%, in accordance with design needs and the design principles described in the present specification. In other embodiments, $\alpha$ may be a percentage less than or equal to 99% by which the distance d can be reduced to obtain h. In some instances, $\alpha$ may be a parameter that factors at least the targeted fluid pressure desired in the dead zone space into the computation of the height h. It is noted that the height h is selected based on design considerations that improve the overall efficiency of the downhole centrifugal pump system 100. For example, a test may be conducted such that given the distance d, various values of $\alpha$ may be selected and a head pressure is observed and recorded for each corresponding h computed for each $\alpha$ for a given operating range 360 of the downhole centrifugal pump system 100. The targeted head pressure that comparatively improves the efficiency of the downhole centrifugal pump system 100 may be selected from the observed and recorded head pressures associated with each $\alpha$. Other factors other than those stated herein may also be considered when computing the height h. Additionally, the height h shown in the illustrated embodiment of FIG. 5 is substantially perpendicular to the distance d between the proximal point 513 and the distal point 512.

Further, the bulge 510 of the protuberated second edge 450*b* may be structured to facilitate a more laminar flow of fluid and also build head pressure in the dead zone. In one embodiment, the bulge 510 may be chamfered or filleted to ease the bulge surface 520 in a manner that optimally allows fluid to flow into the dead zone space 242*b* and to the adjacently upper impeller 214. In some instances, the bulge surface 520 may be based on the angle $2\theta$ as shown. For example, if the planar length l is substantially parallel to the distance d between the proximal point 513 and the distal point 512, and moving in the clockwise direction, $\theta$ may be an angle between the height h and the planar length l. Thus, the illustrated example indicates that $\theta$ may be given by $\theta\leq 90°$.

If $\theta$ is 0° (i.e., 0 degrees), then the planar edge 530 of the bulge surface 520 would be a pointed surface since the bulge surface 520 would sharply decline towards the planar points 521 and 522. However, if $\theta$ is greater than 0° but less than or equal to 90° (i.e., 90 degrees), then the planar edge 530 eases gently towards the planar points 521 and 522 to form a filleted surface or a chamfered surface. That is to say that the bulge surface 520 may be filleted or chamfered based on the angle $\theta$. Other techniques other than those described herein may also be employed in designing the bulge 510 to accomplish desired operational requirements of the downhole centrifugal pump system 100. It is noted, that the planar length l associated with the bulge and the angle $\theta$ may be selected in combination with h to enhance the efficiency of the downhole centrifugal pump system 100. For example, although the bulge surface 520 is shown as being filleted or chamfered along the length of the vane, it may be desired that the bulge surface 520 also be chamfered or filleted across its width (i.e., into and out of the plane of the illustration of the bulge surface 520). Thus, the foregoing indicates that in addition to transferring fluid in a laminar fashion to an adjacently upper impeller 214, the bulge 510 of the diffuser 212 may also be adaptable to facilitate a variable fluid pressure buildup within the dead zone based on one or more of the angle $\theta$, the planar length l, and in some cases, the height h discussed above.

Reference in the specification to "one implementation" or "an implementation" means that a particular feature, structure, or characteristic described in connection with the implementation is included in at least one implementation of the disclosure. The appearances of the phrase "in one implementation," "in some implementations," "in one embodiment," or "in some embodiments" in various places in the specification are not necessarily all referring to the same implementation.

Finally, the foregoing description of the implementations of the present disclosure has been presented for the purposes of illustration and description. It is not intended to be exhaustive or to limit the present disclosure to the precise form disclosed. Many modifications and variations are possible in light of the above teaching. It is intended that the scope of the present disclosure be limited not by this detailed description, but rather by the claims of this application. As will be understood by those familiar with the art, the present disclosure may be embodied in other specific forms without departing from the spirit or essential characteristics thereof. Likewise, the particular naming and division. Accordingly, the disclosure of the present disclosure is intended to be illustrative, but not limiting, of the scope of the present disclosure, which is set forth in the following claims.

What is claimed is:

1. A stationary diffuser for use in a downhole centrifugal pump, the stationary diffuser comprising:

a first axial side for receiving fluid from a first impeller rotationally coupled to the stationary diffuser at the first axial side;

a second axial side for transferring the fluid to a second impeller rotationally coupled to the stationary diffuser at the second axial side;

an inner shaft housing defining a central axis cavity extending from the first axial side to the second axial side, the inner shaft housing configured to accept a rotational shaft passing through the central axis cavity to impart rotation to the first impeller and the second impeller;

a skirt positioned radially within the stationary diffuser and radially surrounding at least a portion of the inner shaft housing; and vanes positioned radially outward from and at least partially around the inner shaft housing an outlet of the vanes being positioned radially within the skirt, the vanes configured to direct fluid flow through fluid passageways defined by the vanes from the first axial side toward the second axial side, at least some of the vanes comprising:

a first upstream end for receiving the fluid output by the first impeller; and a second downstream end comprising a distal edge and a bulge extending axially beyond the distal edge into an open rotational volume of the stationary diffuser in a direction toward the second impeller, wherein:

the bulge extends axially from and beyond the inner shaft housing;

the bulge is further sized and configured to extend axially into an inner housing of the second impeller;

the skirt extends axially beyond the inner shaft housing; and the open rotational volume of the stationary diffuser is defined at the distal edge of each of the at least some of the vanes and within the skirt.

2. The stationary diffuser of claim 1, wherein the bulge comprises an at least partially rounded portion of the at least some of the vanes, the at least partially rounded portion extending beyond the distal edge of the respective vane, the at least partially rounded portion of the bulge configured to continue directing the fluid as the fluid passes the distal edge of the respective vane to additional vanes of the second impeller.

3. The stationary diffuser of claim 1, wherein a geometry of the bulge comprises an enlarged base and a rounded terminal end, the geometry of the bulge selected to facilitate fluid pressure buildup within the open rotational volume.

4. The stationary diffuser of claim 1, wherein the bulge is configured to extend axially toward the second impeller in order to reduce the open rotational volume by at least 10% when the stationary diffuser is coupled to the second impeller.

5. The stationary diffuser of claim 1, wherein the bulge is configured to extend axially toward the second impeller in order to reduce the open rotational volume by at least 20% when the stationary diffuser is coupled to the second impeller.

6. The stationary diffuser of claim 1, wherein the bulge is configured to extend axially toward the second impeller in order to reduce the open rotational volume by at least 30% when the stationary diffuser is coupled to the second impeller.

7. The stationary diffuser of claim 1, wherein the bulge is configured to extend axially toward the second impeller in order to reduce the open rotational volume by at least 40% when the stationary diffuser is coupled to the second impeller.

8. The stationary diffuser of claim 1, wherein a width of the bulge decreases along a height of the bulge.

9. The stationary diffuser of claim 8, wherein the bulge extends axially past the distal edge of the respective vane, where the vanes radially enclose the fluid at the fluid passageways.

10. A downhole centrifugal pump comprising:

impellers;

a rotational shaft passing through the impellers to impart rotation to the impellers; and stationary diffusers positioned between two of the impellers, at least some of the stationary diffusers comprising:

a first axial side for receiving fluid from a first impeller of the impellers coupled to a stationary diffuser of the stationary diffusers at the first axial side;

a second axial side for transferring the fluid to a second impeller of the impellers coupled to the stationary diffuser at the second axial side;

an inner shaft housing defining a central axis cavity defined by the stationary diffuser from the first axial side to the second axial side, the rotational shaft extending through the inner shaft housing;

a skirt positioned radially within the stationary diffuser and radially surrounding at least a portion of the inner shaft housing; and vanes positioned radially outward from and at least partially around the inner shaft housing, the vanes extending to the skirt and configured to direct fluid flow from the first axial side to the second axial side through fluid passageways defined between the skirt and the inner shaft housing of the stationary diffusers, at least some of the vanes defining a protrusion extending axially into an open rotational volume defined between the stationary diffuser and the second impeller, the protrusion further extending axially to and beyond a portion of the second impeller.

11. The downhole centrifugal pump of claim 10, wherein a width of the protrusion decreases along a height of the protrusion and terminates in an at least partially rounded surface.

12. The downhole centrifugal pump of claim 10, wherein a height of the protrusion is between 10% and 40% of a linear path between a base of the protrusion of the at least some of the vanes.

13. The downhole centrifugal pump of claim 10, wherein the protrusion extends axially toward the second impeller in order to reduce the open rotational volume by 10% to 40%.

14. The downhole centrifugal pump of claim 10, wherein the protrusion comprises an at least partially rounded portion of the at least some of the vanes, the at least partially rounded portion extending beyond a fluid exit of the fluid passageways in order to continue directing the fluid as the fluid exits the fluid passageways to additional vanes of the second impeller.

15. A method of pressurizing a fluid with a downhole centrifugal pump, the method comprising:

imparting kinetic energy to the fluid by passing the fluid through a first rotating impeller;

outputting the fluid into a diffuser positioned between the first rotating impeller and a second rotating impeller;

directing the fluid through fluid channels defined by vanes in the diffuser;

outputting the fluid from the fluid channels in the diffuser proximate protuberances defined by terminal ends of the vanes that extend axially to the second impeller through an open section defined between an outlet of the fluid channels and an inlet of the vanes of the second impeller; and imparting potential energy to the fluid with the protuberances of the vanes; and imputing the fluid into the vanes of the second impeller.

16. The method of claim 15, wherein imparting potential energy to the fluid with the protuberances of the vanes comprises building head pressure of the fluid in the open section at least partially with the protuberances of the vanes.

17. The method of claim 15, further comprising pressurizing the fluid through the downhole centrifugal pump proceeding from the first impeller through the diffuser and to the second impeller with the protuberances of the vanes.

18. The method of claim 15, further comprising reducing fluid flow velocity of the fluid as the fluid travels from the first impeller to the second impeller through the diffuser.

19. The method of claim 18, further comprising building fluid pressure in the open section with the protuberances of the vanes.

20. The method of claim 15, further comprising radially surrounding the fluid with the fluid channels of the diffuser.

* * * * *